US006105640A

United States Patent [19]

Holand et al.

[11] Patent Number: 6,105,640

[45] Date of Patent: Aug. 22, 2000

[54] SANDBAG FILLING APPARATUSES AND METHODS OF FORMING SANDBAG FILLING APPARATUSES

[76] Inventors: David D. Holand, 105 W. Main, Suite B, Bozeman, Mont. 59715; Ronald M. Stone, P.O. Box 85, Craigmont, Id. 83523

[21] Appl. No.: 09/010,947

[22] Filed: Jan. 22, 1998

[51] Int. Cl.[7] ..... B65B 1/00

[52] U.S. Cl. ..... 141/391; 141/10; 141/247; 141/316; 141/331; 141/333; 141/337; 141/340

[58] Field of Search ..... 141/10, 247, 248, 141/331, 333, 340–342, 313, 316, 391; 248/94

[56] References Cited

U.S. PATENT DOCUMENTS

| | | | |
|---|---|---|---|
| 215,502 | 5/1879 | Bikle | 141/248 |
| 351,578 | 10/1886 | Colburn | 248/94 |
| 1,290,405 | 1/1919 | Suter | 141/248 |
| 1,500,964 | 7/1924 | Starks . | |
| 2,009,049 | 7/1935 | Henry | 141/248 |
| 2,781,066 | 2/1957 | Weingart | 141/391 |
| 3,112,777 | 12/1963 | Lohse | 141/316 |
| 5,215,127 | 6/1993 | Bergeron | 141/10 |
| 5,226,621 | 7/1993 | Skoff | 248/97 |
| 5,397,085 | 3/1995 | Spagnolo | 248/97 |
| 5,417,261 | 5/1995 | Kanzler | 141/313 |
| 5,597,145 | 1/1997 | Meyers | 248/97 |
| 5,848,625 | 12/1998 | Ebert | 141/316 |
| 5,868,180 | 2/1999 | Hendrickson | 141/331 |

*Primary Examiner*—J. Casimer Jacyna
*Attorney, Agent, or Firm*—Wells, St. John, Roberts, Gregory & Matkin, P.S.

[57] ABSTRACT

Sandbag filling apparatuses and methods of forming sandbag filling apparatuses are described. In one embodiment, a light-weight sandbag filling apparatus includes a base which is placable on the ground proximate a pile of sand. A support member is connected with the base and extends away therefrom. A pair of spaced-apart, sand-intake funnels are supported on opposite sides of the support member. The funnels include respective inlets and outlets and are positioned by the support member above the ground a distance which is sufficient to enable both (a) a person standing on the ground proximate the sand pile to shovel amounts of sand directly into the inlets, and (b) a person or persons to hold a sandbag adjacent one or both of the outlets to receive sand amounts which are shoveled directly into the associated inlet. In another embodiment, a sandbag filling apparatus includes a base, a support post connected with the base and extending away therefrom along a long axis. A sand-receiving platform is connected with the support post and is disposed at an oblique angle relative to the long axis. The oblique angle positions the sand-receiving platform to define a target area for an incoming amount of sand. A sand-receiving passageway is supported by the sand-receiving platform and includes an inlet, an outlet, and a flow axis therebetween and along which the sand can flow. The outlet is positioned to accommodate placement of a sandbag within a fill zone therebeneath for filling.

30 Claims, 7 Drawing Sheets

SANDBAG FILLING APPARATUSES AND METHODS OF FORMING SANDBAG FILLING APPARATUSES

TECHNICAL FIELD

A The present invention relates to sandbag filling apparatuses and methods of forming sandbag filling apparatuses.

BACKGROUND OF THE INVENTION

Sandbags have a wide variety of uses which include providing reinforcement in flood situations, and protection or fortification in various military applications. In flooding situations, emphasis is often placed upon filling sandbags rapidly and deploying them where needed. Typically, in the past, the filling of sandbags has been accomplished by one individual holding a sandbag open, while another individual shovels amounts of sand into the sandbag. Anyone who has undertaken to fill sandbags in this manner will appreciate that a number of problems exist with this method. First, the person doing the shoveling must be very careful to ensure that all or most of the sand in each shovelful makes it into the sandbag. This normally requires the shoveler to slow down briefly, immediately prior to providing the sand into the sandbag. Oftentimes, the shoveler will place the tip of the shovel blade into the sandbag to ensure that all or most of the sand makes it into the bag. This too slows down the sandbag filling process. A second problem which can occur is that an individual holding the sandbag can have their fingers hit or nicked with the blade of the shovel, if the shoveler is not careful. Needless to say, this can give rise to serious injury.

In other situations, such as military applications, the rapidity with which sandbags are filled may not be as critical as the volume of sandbags which are ultimately needed. Manually filling sandbags as described above is a slow and cumbersome process and falls short of enabling a large volume of sandbags to be filled in an efficient manner.

This invention arose out of concerns associated with providing sandbag filling apparatuses and methods of forming sandbag filling apparatuses which enable sandbags to be filled quickly, safely and efficiently.

SUMMARY OF THE INVENTION

Sandbag filling apparatuses and methods of forming sandbag filling apparatuses are described. In one embodiment, a light-weight, sandbag filling apparatus includes a base which is placable on the ground proximate a pile of sand. A support member is connected with the base and extends away therefrom. A pair of spaced-apart, sand-intake funnels are supported on opposite sides of the support member. The funnels include respective inlets and outlets and are positioned by the support member above the ground a distance which is sufficient to enable both (a) a person standing on the ground proximate the sand pile to shovel amounts of sand directly into the inlets, and (b) a person or persons to hold a sandbag adjacent one or both of the outlets to receive sand amounts which are shoveled directly into the associated inlet. In another embodiment, a sandbag filling apparatus includes a base, a support post connected with the base and extending away therefrom along a long axis. A sand-receiving platform is connected with the support post and is disposed at an oblique angle relative to the long axis. The oblique angle positions the sand-receiving platform to define a target area for an incoming amount of sand. A sand-receiving passageway is supported by the sand-receiving platform and includes an inlet, an outlet, and a flow axis therebetween and along which the sand can flow. The outlet is positioned to accommodate placement of a sandbag within a fill zone therebeneath for filling.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
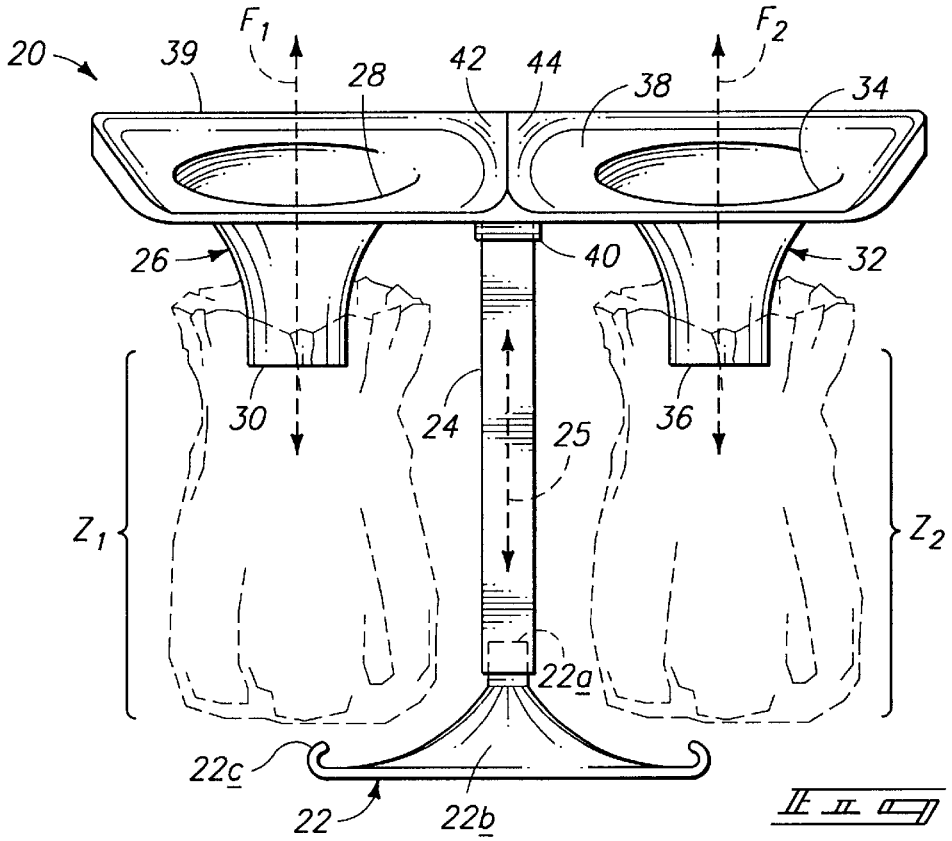
FIG. 1 is a front elevational view of a sandbag filling apparatus constructed in accordance with one aspect of the invention.
Figure 2:
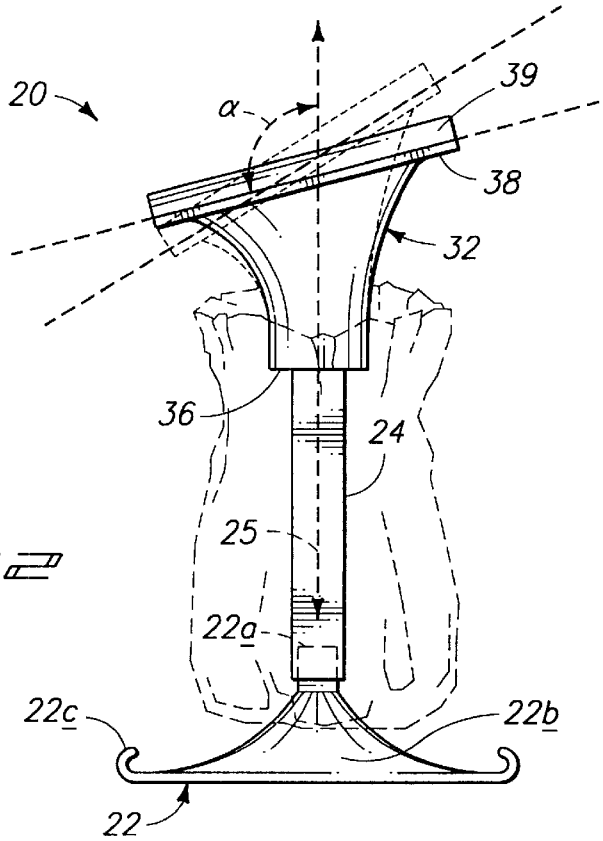
FIG. 2 is a side elevational view of the FIG. 1 apparatus.

Referring to FIGS. 1 and 2, a sandbag filling apparatus in accordance with one aspect of the invention is shown generally at 20. Apparatus 20 includes a base 22 which is placeable on the ground proximate a pile of sand. The illustrated base has a somewhat sloping construction for reasons which will become apparent. A support member 24 is connected with base 22 and extends away therefrom. In a preferred implementation, support member 24 comprises a tubular, injection-molded, lightweight plastic support post which extends along a long axis 25 and is detachably connected with base 22 by virtue of a base portion 22*a* which is sized to fit within an end of support member 24.

A sand-intake funnel 26 is supported by support member 24 and includes an inlet 28 and an outlet 30. A flow axis $F_1$ is defined between inlet 28 and outlet 30, and funnel 26 provides a sand-receiving passageway along or through which sand can flow into a fill zone $Z_1$ which is defined beneath outlet 30. Outlet 30 is preferably positioned by support member 24 at a height which is sufficient to accommodate placement of a sandbag (shown in phantom lines) within fill zone $Z_1$ for filling. As sandbags come in different shapes and sizes, different dimensions of support member 24 are possible to accommodate the same. In the illustrated example, funnel 26 defines a first funnel.

A second sand-intake funnel 32 is supported by support member 24 and includes an inlet 34 and an outlet 36. A flow axis $F_2$ is defined between inlet 34 and outlet 36, and funnel 32 provides a sand-receiving passageway along or through which sand can flow into another fill zone $Z_2$ which is defined beneath outlet 36. Outlet 36 is preferably positioned by support member 24 at a height which is sufficient to accommodate placement of a sandbag (shown in phantom lines) within fill zone $Z_2$ for filling.

In the illustrated and preferred embodiment, sand-intake funnels 26, 32 are supported on opposites sides of support member 24 in a generally balanced, symmetrical disposition. At least one, and preferably both of flow axes $F_1$, $F_2$ are generally straight throughout each respective funnel. The funnels preferably have a degree of taper along the corresponding flow axis for a couple of different reasons. First, the taper allows other, similarly-configured funnels to be nested together to achieve a degree of compactness which assists in storing and transporting large numbers of apparatuses as will be described below. Second, the taper serves to reduce the speed with which sand passes through the passageways defined by each funnel, and, serves to channel the sand into the sandbag. Each illustrated funnel 26, 32 has a generally arcuate taper along its corresponding flow axis toward its respective outlet 30, 36. It will be appreciated, however, that any tapered configuration, e.g. frusto-conical and the like, would suffice. It will further be appreciated that the passageways could have no taper at all. Although the invention is described in the context of an apparatus having two, spaced-apart funnels or passageways for sand, it is to be understood that any number of funnels or passageways could be provided.

In the illustrated example, flow axes $F_1$, $F_2$ are generally parallel with one another and are generally vertically disposed when base 22 is placed on level ground. Preferably, flow axes $F_1$, $F_2$ are generally parallel with long axis 25. Other orientations are possible.

In a preferred implementation, a sand-receiving platform 38 is provided and connected with support post 24. Platform 38 preferably supports each of sand-receiving funnels 26, 32. Sand-receiving platform 38 is preferably disposed, as best seen in FIG. 2, at an oblique angle $\alpha$, relative to long axis 25, which is sufficient to position the platform to define a target area for an incoming amount of sand as will become apparent below. The angulation of the platform faces the platform more in the direction of an individual who is shoveling sand amounts into the funnels. Such is described and illustrated in more detail below. Various angles are possible as indicated by the phantom depiction in FIG. 2. Angles within a range of between about 10° and 35° are preferred.

Sand-receiving platform 38 preferably includes a collar 40 (FIG. 1) which is joined to the underside of the platform, and suitably dimensioned to receive a portion of support post 24. Preferably, collar 40 is configured in transverse cross-sectional dimension to prevent any relative rotational movement between platform 38 and post 24 about long axis 25. In a preferred implementation, base 22, support post 24, and platform 38 are detachably connected with one another, and are formed from durable, injection-molded plastic. Such permits a lightweight apparatus 20 to be quickly assembled and disassembled for transport to and from sand-filling locations. It is to be understood, however, that one or more of the above-described discrete components of apparatus 20 could be formed to be integral components. Moreover, the entire apparatus could be formed as an integral unit.

In a preferred aspect, platform 38 includes a pair of elevated sand-directing ramps 42, 44 disposed intermediate funnels 26, 32. Ramps 42, 44 rise upwardly from a platform surface and include portions which serve to direct sand in the general vicinity of a respective passageway or funnel 26, 32. The platform's surface, which is not specifically designated, can be gently sloped such that surface portions proximate each respective funnel tend to direct sand into the funnel. In this manner, the entire platform can be considered as comprising a pair of funnels. The platform can have other structural features which serve to increase the likelihood that projected sand reaches its ultimate destination. For example, an upraised rim 39 can be provided around the periphery portions of platform 38 to capture sand as it passes thereover. Such rim might, for example, be disposed along the back and individual sides of platform 38.

Figure 3:
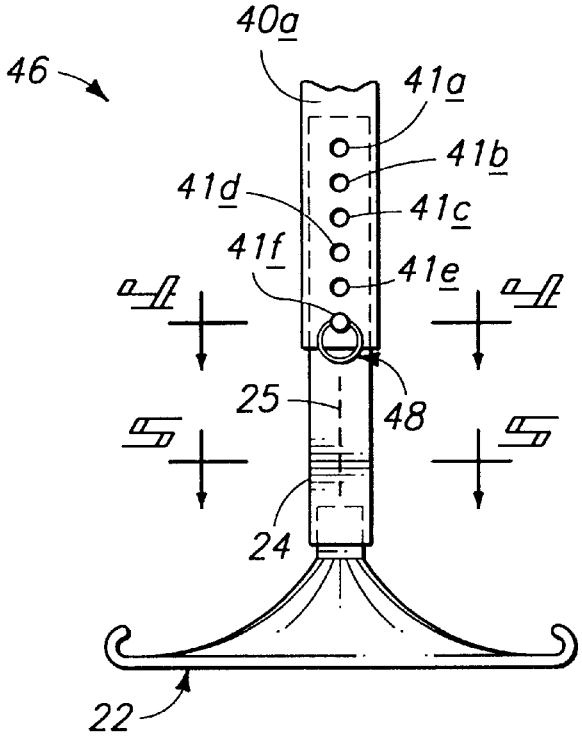
FIG. 3 is a view of a portion of a sandbag filling apparatus constructed in accordance with an alternate embodiment of the present invention.
Figure 4:
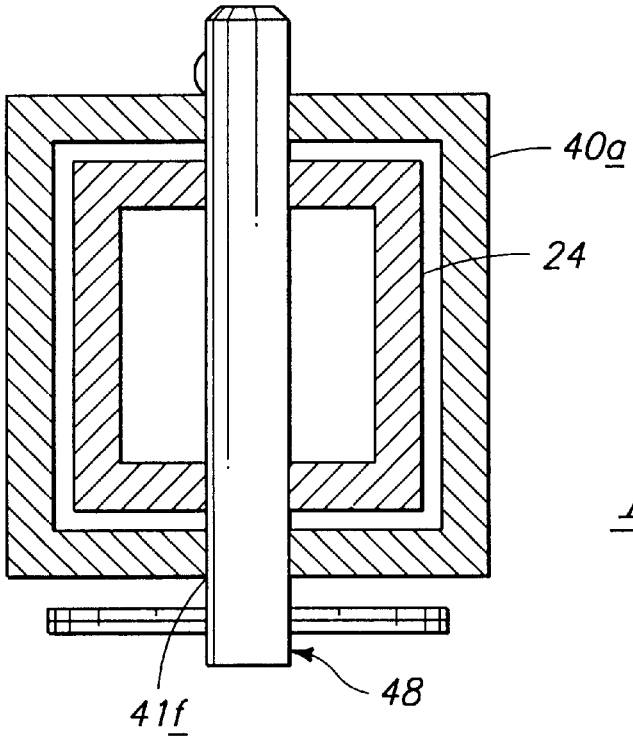
FIG. 4 is a view which is taken along line 4—4 in FIG. 3.

Referring to FIGS. 3 and 4, a portion of an alternate embodiment of the present invention is set forth generally at 46 (FIG. 3) and comprises an apparatus having a height-adjustable, sand-receiving platform. The platform itself, although not specifically shown in FIG. 3, will be understood to be the same in construction as platform 38 in FIG. 1. A different collar 40*a*, however, can be seen to be generally longer in longitudinal dimension than collar 40 of FIG. 1. A plurality of apertures 41*a*–41*f* are provided through collar 40*a* and permit a pin 48 to pass therethrough. Similar in-line apertures are provided through post 24 so that the pin can pass therethrough. The height of the platform is adjusted by simply removing the pin, repositioning collar 40*a* relative to post 24, and reinserting pin 48.

The tubular aspect of post 24 is shown in FIG. 4, where the post can be seen to be generally square in transverse cross-section. Collars 40 (FIG. 1) and 40*a* (FIGS. 3 and 4) are preferably complementary shaped such that any tendency of the platform to rotate about long axis 25 relative to post 24 is reduced, if not eliminated. Other cross-sections are possible.

Figure 5:
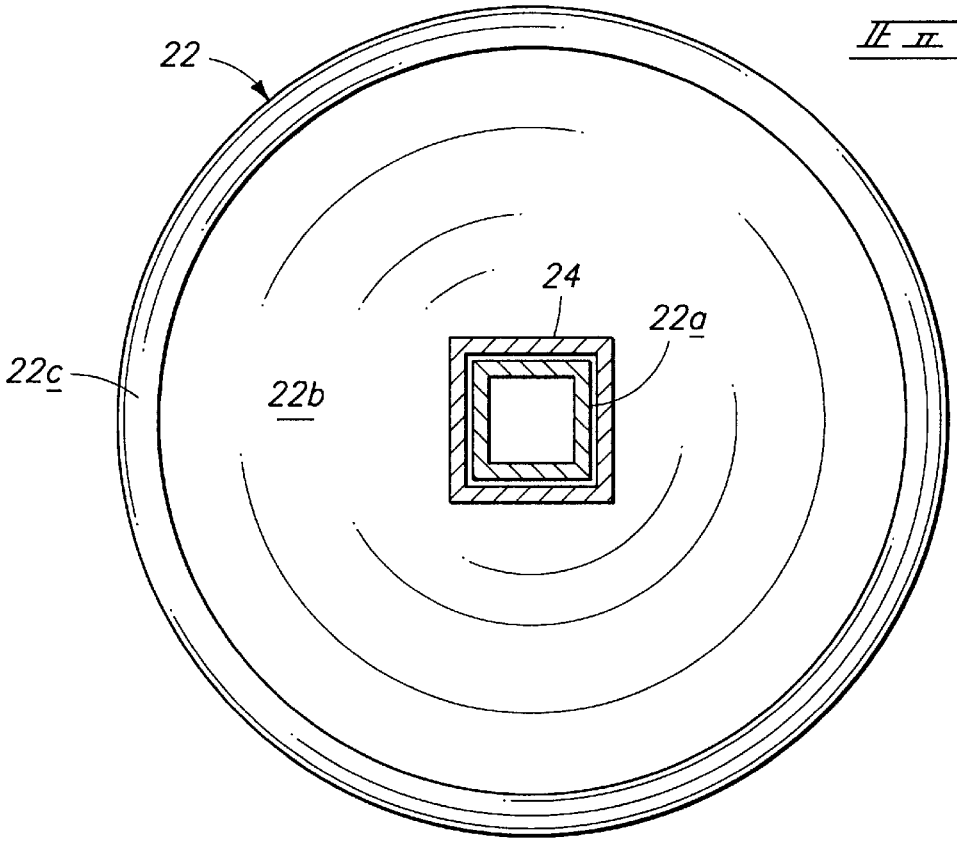
FIG. 5 is a view which is taken along line 5—5 in FIG. 3.
Figure 6:
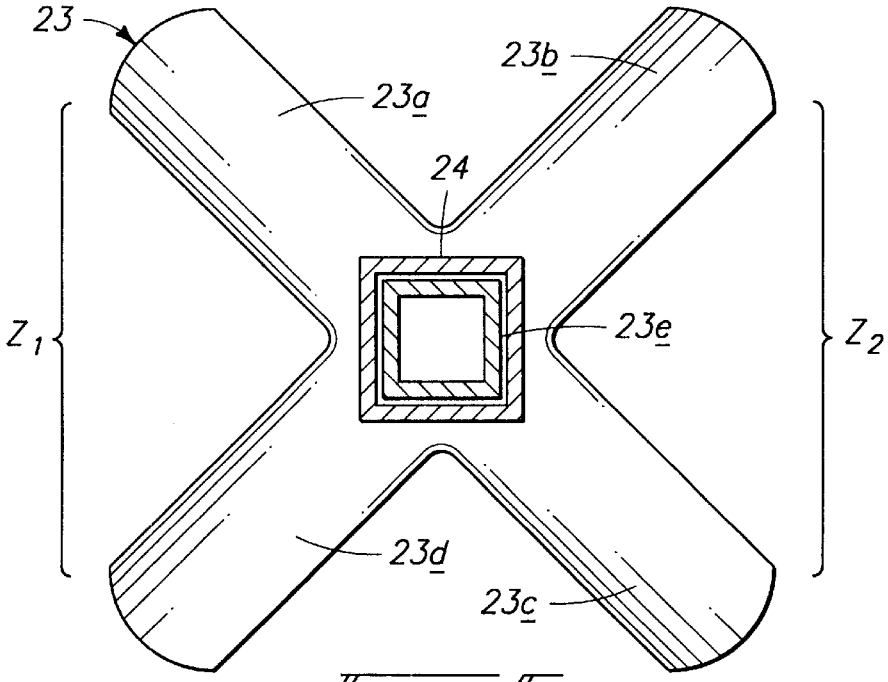
FIG. 6 is a view which is similar to FIG. 5, but which shows an alternate embodiment of a base.

Referring to FIGS. 5 and 6, two separate base constructions are set forth. FIG. 5 is a top plan view of the FIG. 1 base 22, and is preferably circular in shape. Sloping wall portions 22*b* (FIGS. 1 and 5) slope upwardly from an outer perimeter toward, and terminate proximate base portion 22*a* which fits into support member 24 as described above. A lip 22*c* can be, and preferably is provided and extends entirely around the outer perimeter of base 22. Base 22 can be used to retain sand which serves to anchor apparatus 20 in a temporary sand-filling location. Lip 22*c* serves to retain sand or sandbags over wall portions 22*b*.

FIG. 6 shows an alternate base construction generally at 23. Base 23 includes four legs 23*a*, 23*b*, 23*c*, and 23*d*. The legs extend outwardly from a base portion 23*e* which is received within support member or post 24 similar to base portion 22*a* above. Fill zones $Z_1$, $Z_2$ are shown in general relation to each of legs 23*a*–*d*. The disposition of the legs permits sandbags to be moved into and out of the fill zones without meaningful contact therewith. Such facilitates ingress and egress of sandbags within fill zones $Z_1$, $Z_2$. For added structural stability, sand and/or sandbags can be placed over one or more of legs 23*a*–*d*.

Figure 9:
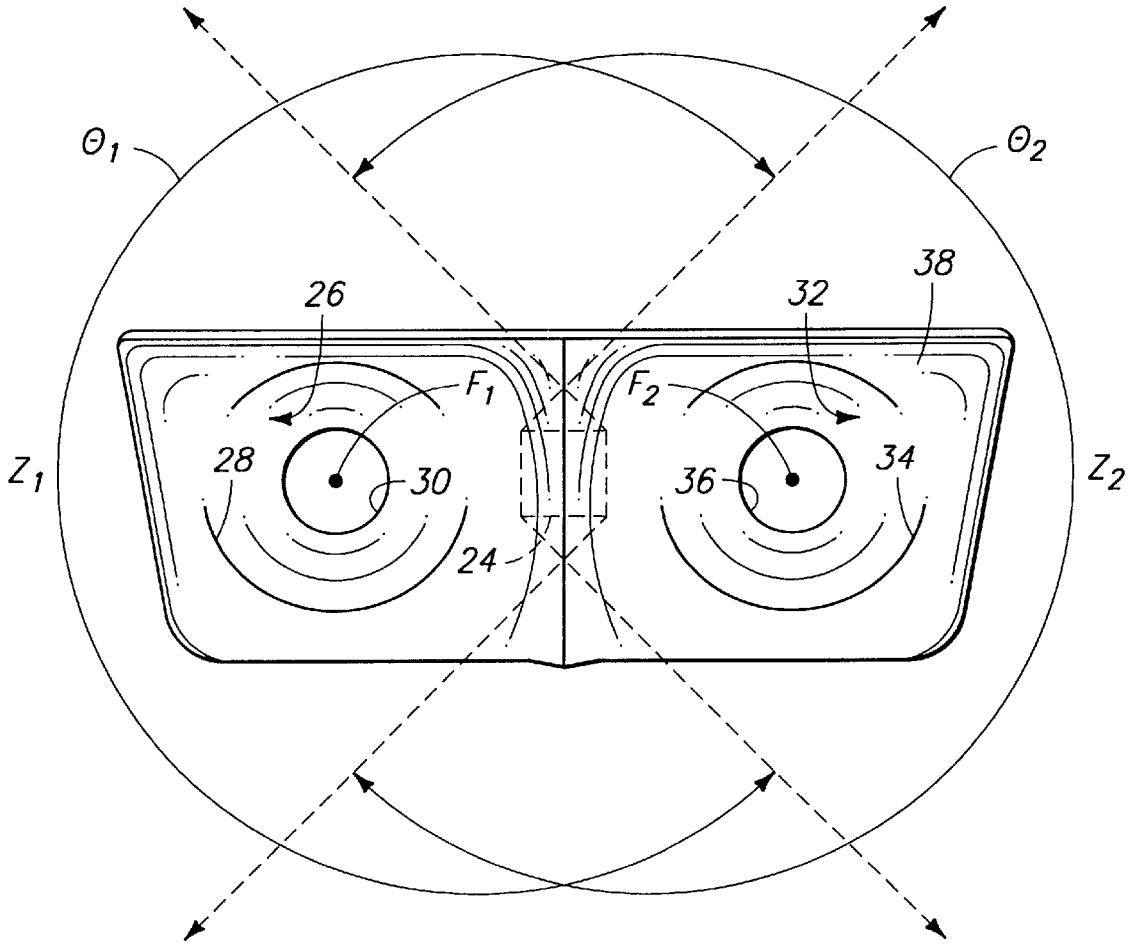
FIG. 9 is a top plan view of a sand-receiving platform.

Referring to FIG. 9, a top plan view of platform 38 is set forth. The preferred construction provides that each fill zone is accessible from a number of different directions. This is an important feature because in time-critical situations, sandbags might desired to be moved into and out of the fill zones from many different directions. In the illustrated example and by virtue of the center-post construction, i.e. post 24, each fill zone $Z_1$, $Z_2$ has a degree of unencumbered access which is greater than about 200 degrees. Specifically, and with respect to fill zone $Z_1$, an angle $\theta_1$ is defined between two dashed lines which are drawn relative to support post 24. Angle $\theta_1$ defines an arc which lies in a plane which is generally normal to flow axis $F_1$. Preferably, angle $\theta_1$ is equal to approximately 270 degrees. Such unencumbered access to fill zone $Z_1$ permits sandbags to be moved into and out of the fill zone very rapidly, and from a number of different directions including from the front, side and rear of the fill zone. Similarly, fill zone $Z_2$ has a desired degree of unencumbered access which is greater than about 200 degrees, and preferably approximately 270 degrees. Specifically, an angle $\theta_2$ is defined between two dashed lines which are drawn relative to support post 24. Angle $\theta_2$ defines an arc which lies in a plane which is generally normal to flow axis $F_2$. Accordingly, sandbags can be moved into and out of fill zone $Z_2$ very rapidly and from a number of different directions including from the front, side, and rear of the fill zone.

Figure 7:
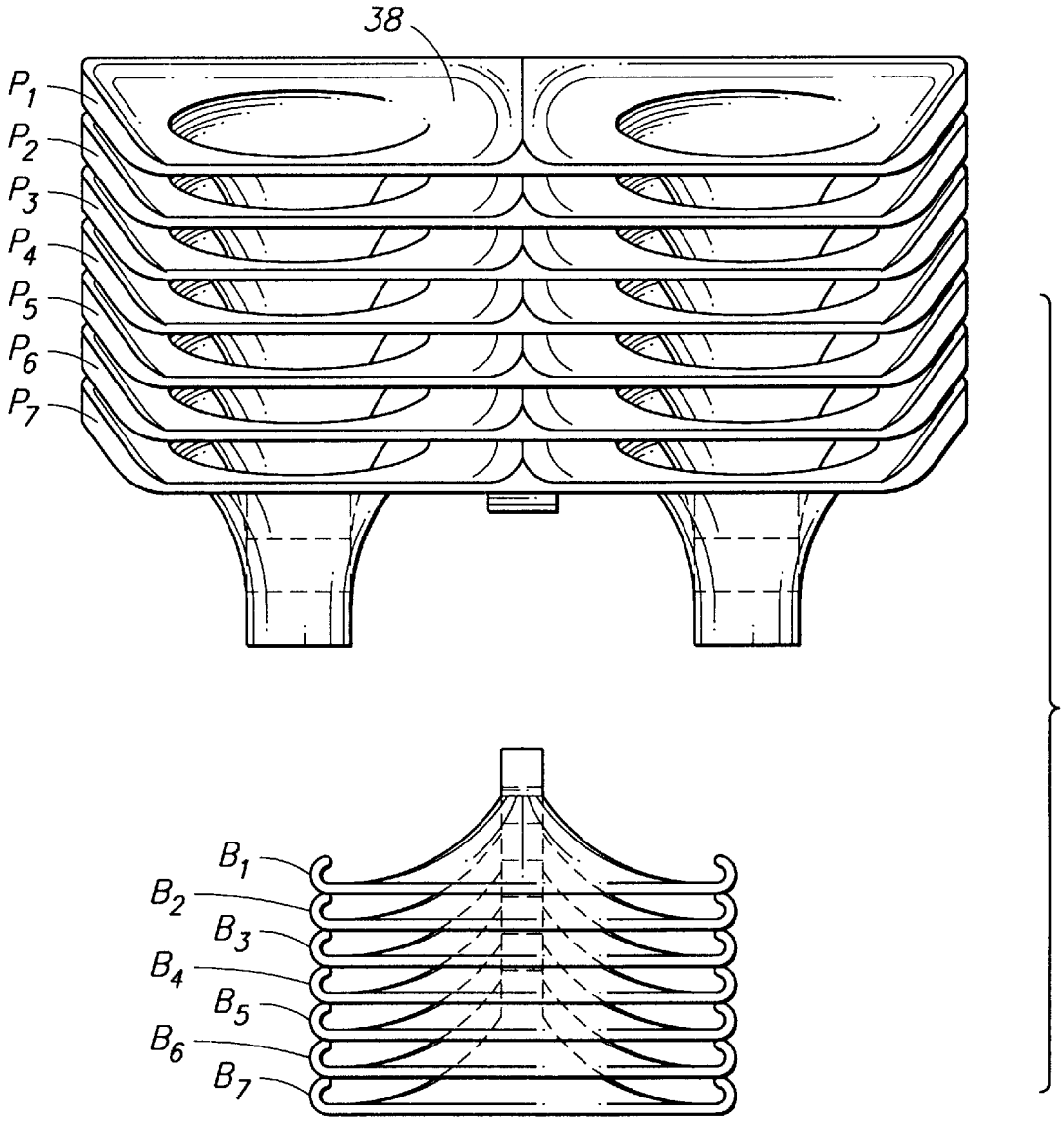
FIG. 7 is a front elevational view of a plurality of sand-receiving platforms constructed in accordance with a preferred aspect of the invention, and one which shows a nestability feature of the platforms.

Referring to FIG. 7, and in accordance with one preferred aspect of the invention, a plurality of connected-together, spaced-apart, sand-intake funnel pairs, e.g. platforms 38, are provided at $P_1$, $P_2$, $P_3$, $P_4$, $P_5$, $P_6$, $P_7$. Each funnel pair is preferably capable of being detached from an individual base such as those bases described above. Preferably, each funnel pair is configured to, when detached from its associated base, be nestedly received by, or, nestedly receive at least one other funnel pair. As so received, portions of the individual funnels comprising each pair are received inside of a respective individual funnel of another pair. The nested configuration allows a system of sandbag filling apparatuses to be mass transported between sand filling locations. Also shown are a plurality of individual nested-together bases $B_1$, $B_2$, $B_3$, $B_4$, $B_5$, $B_6$, and $B_7$ which are individually associated with a respective one of the platforms.

In a preferred aspect, apparatus 20, and in particular sand-receiving platforms 38 are injection molded out of plastic which is both durable enough to resist the abuses encountered in the operating environment and to provide a lightweight apparatus. In particular, each apparatus is preferably light enough to be carried by one person from location-to-location for filling sandbags.

Figure 8:
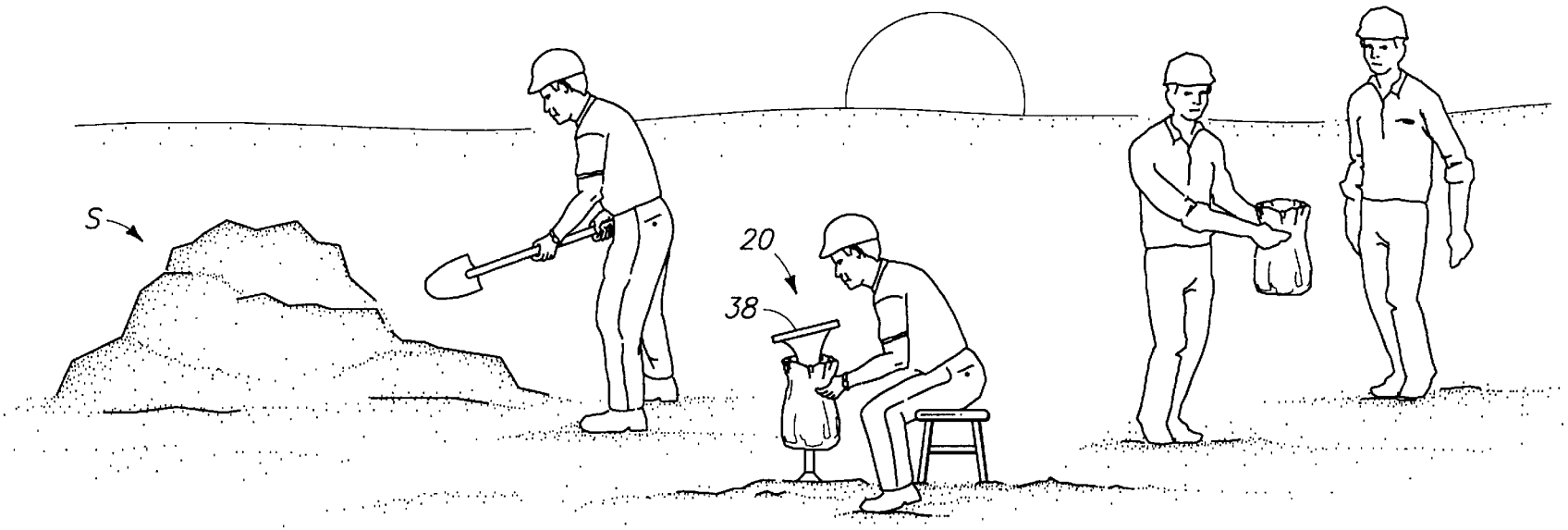
FIG. 8 is an environmental view of a sandbag filling apparatus and one which shows its use in the context of a situation in which rapid filling of sandbags is desired.

Referring to FIG. 8, an exemplary apparatus 20 is shown in operation. Preferably, one or more funnels are supported by support member 24 (FIG. 1) above the ground a distance which is sufficient to enable both a person or persons standing on the ground proximate a sand pile S to shovel amounts of sand directly into the inlets of each funnel, and to enable a person or persons to hold a sandbag adjacent one of the outlets to receive sand amounts which are shoveled directly into the associated inlet. Although only one person is shown in a seated position manning a sandbag, the apparatus is dimensioned to permit two individuals to sit side-by-side to monitor and man different sandbags. With platform 38 being preferably angulated as described above, an individual shoveling amounts of sand into each inlet has a target area which faces them and permits them to rapidly shovel sand into and through each funnel and the corresponding sandbag disposed therebeneath.

In some instances, only one person may be available to fill sandbags. In these instances, suitable capture mechanisms can be provided on apparatus 20 to allow an individual to temporarily attach a sandbag within the fill zone and then subsequently fill it. One such mechanism is shown in FIG. 10, and another in FIG. 11.

Figure 10:
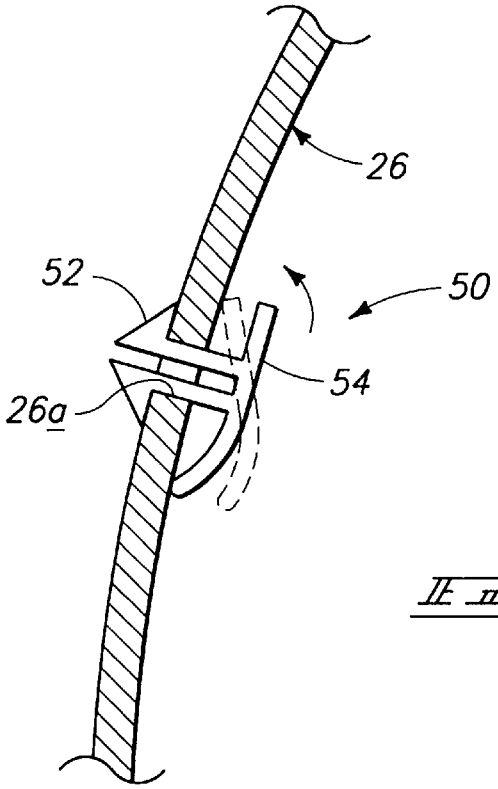
FIG. 10 is a view of an exemplary capture mechanism which can be utilized to secure a sandbag in connection with one aspect of the invention.

FIG. 10 shows a portion of funnel 26 having an aperture 26*a* therein. A clasp member 50 is provided and includes an anchor mechanism 52 received by aperture 26*a,* and a depressible tab 54 disposed on the outside of the funnel. Tab 54, when depressed, raises a distal end thereof (indicated in phantom) which allows a portion of a sandbag to be slipped underneath and secured when tab 54 is released. A similar tab can be mounted on an opposite side of the funnel such that another sandbag portion can be temporarily secured as described.

Figure 11:
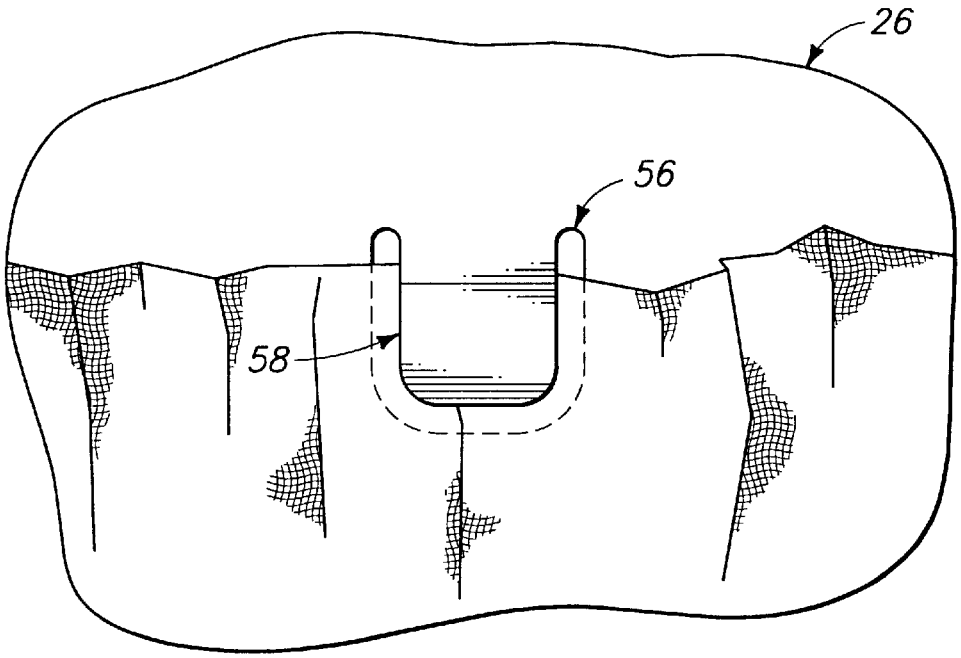
FIG. 11 is a view of an exemplary capture mechanism which can be utilized to secure a sandbag in connection with one aspect of the is invention.

FIG. 11 shows an outside portion of funnel 26 which includes a groove 56 formed therein. The groove defines a tab 58. A sandbag portion (which has been shaded for clarity) can be slipped under the tab and retained relative to the groove to permit a single person to secure a sandbag for filling. A similar groove and tab can be provided on an opposite side of the funnel for securing a sandbag as described.

The above constitute but two exemplary capture mechanisms which can be utilized to enable an individual secure a sandbag for filling. Other capture mechanisms are possible.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A lightweight sandbag filling apparatus comprising:

a base, placeable on the ground proximate a pile of sand;

a support member connected with the base and extending away therefrom along a long axis; and a pair of spaced-apart, sand-intake funnels supported on opposite sides of the support member, the funnels comprising respective inlets and outlets, sand-receiving platforms leading to the inlets and formed at an oblique angle to the long axis;

the funnels and sand-receiving platforms being positioned by the support member above the ground a distance which is sufficient to enable both (a) a person standing on the ground proximate the sand pile to shovel amounts of sand directly into the inlets, and (b) a person to hold a sandbag adjacent one of the outlets to receive sand amounts which are shoveled directly into the associated inlet.

2. The sandbag filling apparatus of claim 1, wherein at least one of the sand-intake funnels is configured to direct sand along a flow axis which is generally straight throughout the funnel.

3. The sandbag filling apparatus of claim 1, wherein each sand-intake funnel is configured to direct sand along respective flow axes which are generally straight throughout each respective funnel.

4. The sandbag filling apparatus of claim 3, wherein said flow axes are generally parallel with one another.

5. The sandbag filling apparatus of claim 3, wherein said flow axes are generally vertically disposed when said base is placed on level ground.

6. The sandbag filling apparatus of claim 3, wherein said support member comprises a single elongate support post which extends away from said base along a long axis, and wherein one of said flow axes is generally parallel with said long axis.

7. The sandbag filling apparatus of claim 3, wherein said support member comprises a single elongate support post which extends away from said base along a long axis, and wherein both of said flow axes are generally parallel with said long axis.

8. The sandbag filling apparatus of claim 1 further comprising a capture mechanism on at least one of the funnels for securing a sandbag portion thereon.

9. A lightweight, one-person-carriable sandbag filling apparatus comprising:

a base;

a support post connected with the base and extending away therefrom along a long axis;

a sand-receiving platform connected with the support post and disposed at an oblique angle relative to said long axis, wherein said oblique angle positions said sand-receiving platform to define a inclined target area substantially facing an incoming amount of sand; and an upright sand-receiving passageway supported by the sand-receiving platform and having an inlet opening through the platform and that is inclined with the sand-receiving platform, a substantially vertically downwardly disposed outlet, and an upright flow axis therebetween and along which said sand amounts can flow, said outlet being positioned to accommodate placement of a sandbag within a fill zone therebeneath for filling.

10. The lightweight, one-person-carriable sandbag filling apparatus of claim 9, wherein said sand-receiving passageway tapers along said flow axis.

11. The lightweight, one-person-carriable sandbag filling apparatus of claim 9, wherein said sand-receiving passageway tapers along said flow axis toward said outlet.

12. The lightweight, one-person-carriable sandbag filling apparatus of claim 9, wherein said flow axis is generally parallel to said support post long axis.

13. The lightweight, one-person-carriable sandbag filling apparatus of claim 9, wherein said support post and said base are detachably connected with one another.

14. The lightweight, one-person-carriable sandbag filling apparatus of claim 9, wherein said sand-receiving platform and said support post are detachably connected with one another.

15. The lightweight, one-person-carriable sandbag filling apparatus of claim 9, wherein said fill zone has greater than about 200 degrees of unencumbered access thereto about an arc which lies in a plane which is generally normal to said flow axis.

16. The lightweight, one-person-carriable sandbag filling apparatus of claim 9, wherein:

said sand-receiving passageway comprises a first passageway and further comprising a second sand-receiving passageway supported by the sand-receiving platform and having an inlet, an outlet, and a flow axis therebetween and along which sand can flow, said outlet being positioned to accommodate placement of another sandbag within another fill zone therebeneath for filling.

17. The lightweight, one-person-carriable sandbag filling apparatus of claim 16, wherein said first and second sand-receiving passageways are supported on opposite sides of said support post.

18. The lightweight, one-person-carriable sandbag filling apparatus of claim 17, wherein said sand-receiving platform comprises a pair of elevated sand-directing ramps disposed intermediate the sand-receiving passageways, individual ramps having portions serving to direct sand in the general vicinity of a respective one of the passageways.

19. The lightweight, one-person-carriable sandbag filling apparatus of claim 16, wherein one of said sand-receiving passageways tapers along its flow axis.

20. The lightweight, one-person-carriable sandbag filling apparatus of claim 16, wherein the flow axes of said first and second sand-receiving passageways are generally parallel with one another.

21. The lightweight, one-person-carriable sandbag filling apparatus of claim 20, wherein said flow axes of said first and second sand-receiving passageways are generally parallel with said long axis.

22. The lightweight, one-person-carriable sandbag filling apparatus of claim 16, wherein each fill zone associated with said first and second sand-receiving passageways has, respectively, greater than about 200-degrees of unencumbered access about an arc which lies in a plane which is generally normal to the flow axis of each sand-receiving passageway.

23. The lightweight, one-person-carriable sandbag filling apparatus of claim 9, wherein said sand-receiving platform is adjustably mounted on said support post to accommodate height adjustments along the long axis.

24. The lightweight, one-person-carriable sandbag filling apparatus of claim 9 further comprising a capture mechanism on said sand-receiving passageway to permit a sandbag to be secured thereon.

25. A system of nestable, lightweight, one-person-carriable sandbag filling apparatuses comprising:

a plurality of bases;

a plurality of connected-together, spaced-apart, sand-intake funnel pairs comprising respective inlets and outlets through which sand can pass, individual pairs of said connected-together sand-intake funnels being detachably connectable with individual respective ones of said plurality of bases, wherein each funnel pair is nestedly receivable by one other funnel pair, at least portions of the individual funnels of one funnel pair being received inside of respective individual funnels of another pair.

26. The system of nestable, lightweight, one-person-carriable sandbag filling apparatuses of claim 25, wherein individual funnels of each funnel pair comprise respective flow axes which extend between each's respective inlet and outlet, wherein said flow axes are generally parallel.

27. The system of nestable, lightweight, one-person-carriable sandbag filling apparatuses of claim 25, wherein each funnel of said plurality of funnel pairs tapers generally along a flow axis which is disposed between its respective inlet and outlet.

28. The system of nestable, lightweight, one-person-carriable sandbag filling apparatuses of claim 25, wherein said apparatuses comprise injection-molded plastic.

29. A sandbag filling apparatus-forming method comprising:

providing a base;

providing a support post connected with the base and extending away therefrom along a long axis;

providing a sand intake funnel, the funnel including an inlet and an outlet;

providing a sand-receiving platform leading to the inlet; and connecting said sand-receiving platform with said support post wherein said platform is disposed at an oblique angle relative to said long axis and defines a target area for an incoming amount of sand.

30. The sandbag-filling-apparatus-forming method of claim 29, wherein said providing of said sand-receiving platform and said sand-receiving passageway comprises injection molding said platform and said passageway out of plastic.

* * * * *